US012110613B2

(12) United States Patent
Shin

(10) Patent No.: US 12,110,613 B2
(45) Date of Patent: Oct. 8, 2024

(54) METHOD FOR RECYCLING NONWOVEN FABRIC

(71) Applicant: Dong Soo Shin, Gwangmyeong-si (KR)

(72) Inventor: Dong Soo Shin, Gwangmyeong-si (KR)

( * ) Notice: Subject to any disclaimer, the term of this patent is extended or adjusted under 35 U.S.C. 154(b) by 571 days.

(21) Appl. No.: 17/293,913

(22) PCT Filed: Jan. 8, 2020

(86) PCT No.: PCT/KR2020/000315

§ 371 (c)(1),
(2) Date: May 14, 2021

(87) PCT Pub. No.: WO2020/149562

PCT Pub. Date: Jul. 23, 2020

(65) Prior Publication Data

US 2022/0010464 A1 Jan. 13, 2022

(30) Foreign Application Priority Data

Jan. 16, 2019 (KR) ..... 10-2019-0005907

(51) Int. Cl.
*D01G 13/00* (2006.01)
*D01G 7/06* (2006.01)
(Continued)

(52) U.S. Cl.
CPC ..... *D01G 11/00* (2013.01); *D01G 7/06* (2013.01); *D01G 13/00* (2013.01); *D04H 1/4274* (2013.01); *D04H 1/44* (2013.01)

(58) Field of Classification Search
CPC ..... D01G 11/00; D01G 7/06; D01G 13/00; D04H 1/4274; D04H 1/44
See application file for complete search history.

(56) References Cited

U.S. PATENT DOCUMENTS 5,616,408 A * 4/1997 Oleszczuk ..... D01F 6/30 156/308.2
6,037,282 A * 3/2000 Milding ..... D04H 1/425 428/903.3
6,520,425 B1 * 2/2003 Reneker ..... D01D 4/025 239/294

FOREIGN PATENT DOCUMENTS

JP 10-504613 A 5/1998
KR 10-1996-0002054 B1 2/1996
(Continued)

OTHER PUBLICATIONS

Translation of KR100866648B1 (Year: 2024).*
International Search Report for PCT/KR2020/000315 mailed Apr. 14, 2020 from Korean Intellectual Property Office.

*Primary Examiner* — Khoa D Huynh
*Assistant Examiner* — Erick I Lopez

(57) ABSTRACT

A method for recycling a nonwoven fabric, including: a waste nonwoven fabric pulverization step of pulverizing a waste nonwoven fabric to obtain pulverized waste nonwoven fabric particles; a material mixing step of dispersing and mixing the pulverized nonwoven fabric particles and a filler in water to obtain a nonwoven fabric mixture; a raw material mixing step of adding a fixing agent for agglomeration of the pulverized waste nonwoven fabric particles and the filler to the nonwoven fabric mixture, followed by mixing, to form a raw material; a draining step of separating and removing water from the raw material to form a recycled nonwoven fabric sheet; a first lamination step of laminating the plurality of recycled nonwoven fabric sheets to form a laminate; and a compressing/dehydrating step of compressing and dehydrating the laminate.

9 Claims, 11 Drawing Sheets

(51) Int. Cl.

| | |
|---|---|
| ***D01G 11/00*** | (2006.01) |
| ***D04H 1/4274*** | (2012.01) |
| ***D04H 1/44*** | (2006.01) |

(56) References Cited

FOREIGN PATENT DOCUMENTS

| | | | | | |
|---|---|---|---|---|---|
| KR | 10-2001-0070734 | A | | 7/2001 | |
| KR | 100866648 | B1 | * | 7/2006 | ..... B29D 7/01 |
| KR | 10-0974173 | B1 | | 8/2010 | |
| KR | 10-2017-0045498 | A | | 4/2017 | |
| KR | 101941264 | B1 | * | 8/2018 | ..... D01G 11/00 |

* cited by examiner

METHOD FOR RECYCLING NONWOVEN FABRIC

TECHNICAL FIELD

The present invention relates to technology of recycling nonwoven fabrics, and more particularly, to a method for producing a recycling nonwoven fabric by using a waste nonwoven fabric.

BACKGROUND ART

As a prior-art patent document related to the technology of producing recycling nonwoven fabrics by using waste nonwoven fabrics, Korean Patent Registration No. 10-0974173 discloses a process, whereby waste nonwoven fabrics are cut to a certain size in a cutting device and then the cut waste nonwoven fabrics are temporarily stored in a storage unit, the waste nonwoven fabrics are sprayed with a certain thickness and a certain amount by using an airlaid and in this case, low melting point fibers and short fibers forming a surface layer are stacked by a carding machine via an additional conveying conveyor, the low melting point fibers and the short fibers are needle punched using a needle punching device to apply pressure with a pressurizing unit having a high temperature and to press, thereby producing recycling nonwoven fabrics.

DETAILED DESCRIPTION OF THE INVENTION

Technical Problem

The present invention provides a method for recycling a nonwoven fabric so as to produce a recycling nonwoven fabric by using a waste nonwoven fabric.

Technical Solution

According to an aspect of the present invention, there is provided a method for recycling a nonwoven fabric, the method including: a waste nonwoven fabric pulverization operation of pulverizing a waste nonwoven fabric to obtain pulverized waste nonwoven fabric particles; a material mixing operation of dispersing and mixing the pulverized nonwoven fabric particles and a filler in water to obtain a nonwoven fabric mixture; a raw material mixing operation of adding a fixing agent for agglomeration of the pulverized waste nonwoven fabric particles and the filler to the nonwoven fabric mixture, followed by mixing, to form a raw material; a draining operation of separating and removing water from the raw material to form a recycled nonwoven fabric sheet; a first lamination operation of laminating the plurality of recycled nonwoven fabric sheets to form a laminate; and a compressing/dehydrating operation of compressing and dehydrating the laminate.

According to another aspect of the present invention, there is provided a method of recycling a nonwoven fabric, the method including: a waste nonwoven fabric pulverization operation of pulverizing a plurality of different types of waste nonwoven fabrics to obtain a plurality of different types of waste nonwoven fabric particles; a material mixing operation of dispersing and mixing the plurality of different types of pulverized nonwoven fabric particles and a filler in water to obtain a plurality of different types of nonwoven fabric mixtures; a raw material mixing operation of adding a fixing agent for agglomeration of the pulverized waste nonwoven fabric particles and the filler to the plurality of different types of nonwoven fabric mixtures, followed by mixing, to form a plurality of different types of raw materials; a draining operation of separating and removing water from the plurality of different types of raw materials to form a plurality of different types of recycled nonwoven fabric sheets; a first lamination operation of laminating the plurality of different types of recycled nonwoven fabric sheets to form a laminate; and a compressing/dehydrating operation of compressing and dehydrating the laminate.

According to another aspect of the present invention, there is provided a method of recycling a nonwoven fabric, the method including: a waste nonwoven fabric pulverization operation of pulverizing a waste nonwoven fabric to obtain pulverized waste nonwoven fabric particles; a material mixing operation of dispersing and mixing the pulverized nonwoven fabric particles and a filler in water to obtain a nonwoven fabric mixture; a raw material mixing operation of adding a fixing agent for agglomeration of the pulverized waste nonwoven fabric particles and the filler to the nonwoven fabric mixture, followed by mixing, to form a raw material; a raw material feeding operation of spraying the raw material into an upper space by using a raw material discharging nozzle and supplying the raw material; a raw material settling operation of settling the raw material filled in the upper space into an intermediate space, which is located below the upper space and in which a filter net for passing water downward is installed on a bottom; a draining operation of draining water from a lower space located below the intermediate space to form a nonwoven fabric recycling sheet on the filter net; and a first lamination operation of laminating a plurality of nonwoven fabric recycling sheets to form a laminate, wherein the raw material discharging nozzle includes a plurality of spray holes through which the raw material is discharged, formed therein and a raw material discharging surface convexly formed in a downward direction, and the raw material is uniformly sprayed into the upper space.

Effects of the Invention

According to the present invention, all the objectives of the present invention described above can be achieved. Specifically, since a fixing agent is added to a nonwoven fabric mixture formed by mixing pulverized waste nonwoven fabric particles and a filler in water with each other and then supplied to a filter tank to obtain a nonwoven fabric recycling sheet through a primary dispersion process, a secondary dispersion process and a drainage process, the process can be simplified compared to the related art and as such, the effects of cost reduction and productivity improvement can be expected.

MODE OF THE INVENTION

Hereinafter, the configuration and operation of embodiments of the present invention will be described with reference to the accompanying drawings.

Figure 1:
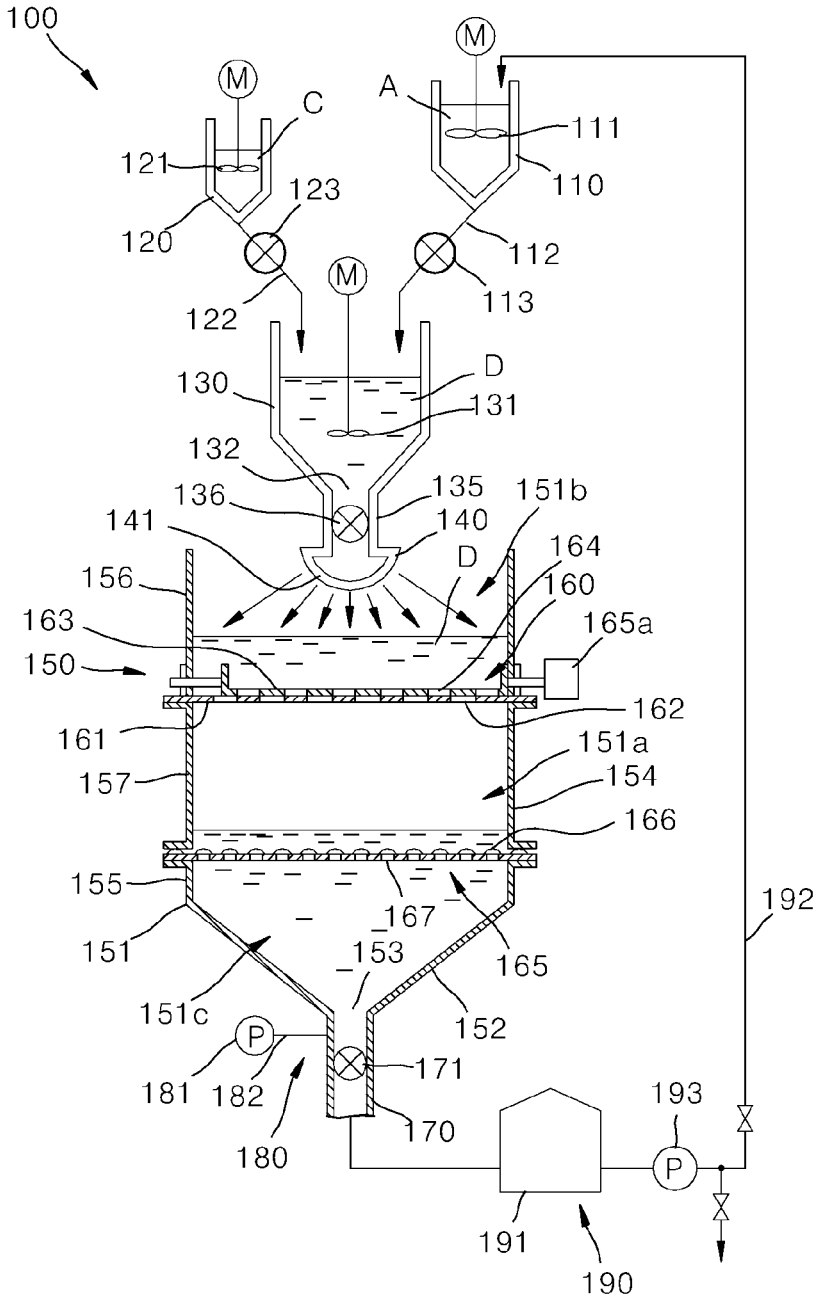
FIG. 1 is a view schematically illustrating an apparatus for recycling a nonwoven fabric used in a method for recycling a nonwoven fabric according to an embodiment of the present invention.

The configuration of an apparatus for recycling a nonwoven fabric used in a method for recycling a nonwoven fabric according to an embodiment of the present invention is schematically shown in FIG. 1. Referring to FIG. 1, an apparatus 100 for recycling a nonwoven fabric includes a mixing tank 110 in which pulverized waste nonwoven bodies and a filler are dispersed in water and mixed with each other to form a waste nonwoven fabric mixture, a fixing agent mixture storage tank 120 in which a fixing agent mixture solution mixed with the fixing agent is stored, a raw material mixing tank 130 in which a raw material formed by mixing the waste nonwoven fabric mixture supplied from the mixing tank 110 and the fixing agent mixture solution supplied from the fixing agent mixture storage tank 120 with each other is stored, a raw material discharging nozzle 140 through which the raw material stored in the raw material mixing tank 130 is discharged, a filter tank 150 in which a recycling sheet material is manufactured by using the raw material discharged through the raw material discharging nozzle 140, a drainage pipe 170 through which water is discharged from the filter tank 150, a vacuum forming unit 180 connected to the drainage pipe 170, and a water recycling unit 190 which is connected to the drainage pipe 170 and supplies water drained through the drainage pipe 170 to the mixing tank 110.

In the mixing tank 110, the pulverized waste nonwoven bodies and the filler are dispersed in water and mixed with each other to form a waste nonwoven fabric mixture A. To this end, the mixing tank 110 includes an agitating unit 111. The pulverized waste nonwoven bodies are obtained by finely pulverizing a nonwoven fabric scrap or nonwoven fabric waste generated in the manufacturing process of a nonwoven fabric product by using a pulverizer, and it is preferable that the pulverized waste nonwoven fabric particles having the same properties are used. The nonwoven fabric used in the present invention includes various fiber materials, for example, natural fibers such as wool, synthetic fibers such as aramid fibers or carbon fibers, inorganic fibers such as ceramic fibers, and metal fibers. It is preferable that the pulverized waste nonwoven fabric particles have a length of 10 mm or less. As the filler, various functional fillers including resin materials for bonding and controlling properties of the pulverized waste nonwoven fabric particles are used. In the mixing tank 110, the pulverized waste nonwoven fabric particles and the filler are supplied in a state in which the mixing tank 110 is filled with water, and the pulverized waste nonwoven fabric particles and the filler supplied to water are evenly dispersed and mixed in water by the agitating unit 111. In the present embodiment, the pulverized waste nonwoven fabric particles and the filler in the waste nonwoven fabric mixture A have a weight ratio of 8:2. Water used in the mixing tank 110 is water obtained by recycling water drained through the drainage pipe 170 by the water recycling unit 190. The waste nonwoven fabric mixture A stored in the mixing tank 110 is discharged downward by its own weight and is supplied to the raw material mixing tank 130. A first opening/closing valve 113 that controls the flow of the waste nonwoven fabric mixture A is installed on a first transfer line 112 in which the waste nonwoven fabric mixture A discharged from the mixing tank 110 is guided to the raw material mixing tank 130. The mixing tank 110, the first transfer line 112, and the first opening/closing valve 113 constitute a waste nonwoven fabric mixture supplying unit.

A fixing agent mixed solution C in which the fixing agent is mixed, is stored in the fixing agent mixture storage tank 120. The agitating unit 121 is installed in the fixing agent mixture storage tank 120 so that the fixing agent is uniformly dispersed in the fixing agent mixed solution C and mixed with each other. The fixing agent mixed solution C stored in the fixing agent mixture storage tank 120 is discharged downward by its own weight and is supplied to the raw material mixing tank 130. A second opening/closing valve 123 that controls the flow of the waste nonwoven fabric mixture A installed on a second transfer line 122 in which the fixing agent mixed solution C discharged from the fixing agent mixture storage tank 120 is guided to the raw material mixing tank 130. The pulverized waste nonwoven fabric particles included in the waste nonwoven fabric mixture Z may be structurally agglomerated and fixed to each other by the fixing agent mixed in the fixing agent mixed solution C. The fixing agent may be one commonly used, such as polyvinyl acetate resin and sodium thiosulfate. The fixing agent mixture storage tank 120, the second transfer line 122, and the second opening/closing valve 123 constitute a fixing agent supplying unit.

A raw material D formed by mixing the waste nonwoven fabric mixture A supplied from the mixing tank 110 and the fixing agent mixed solution C supplied from the fixing agent mixture storage tank 120 with each other, is stored in the raw material mixing tank 130. The agitating unit 131 is installed in the raw material mixing tank 130 so that elements that constitute the raw material D are uniformly dispersed and mixed with each other. The raw material D stored in the raw material mixing tank 130 is discharged through an outlet 132 formed on the bottom of the raw material mixing tank 130, and the raw material D discharged through the outlet 132 flows downward by its own weight through an extension pipe 135 that extends from the outlet 132 downward and is moved to the raw material discharging nozzle 140. A control valve 136 for controlling the movement of the raw material D to the raw material discharging nozzle 140 through the extension pipe 135 is installed on the extension pipe 135.

Figure 2:
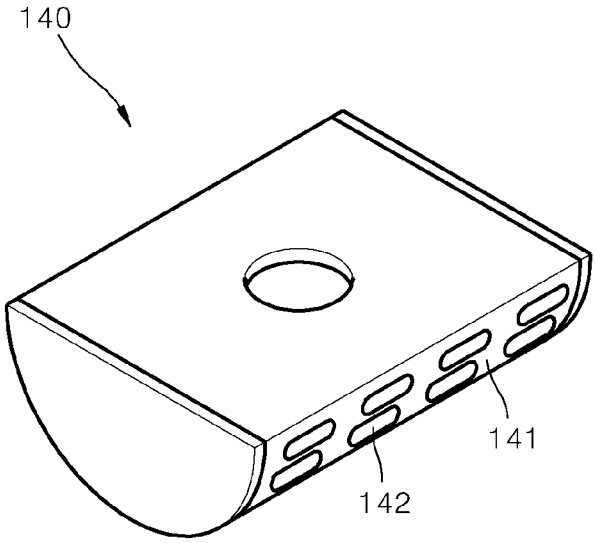
FIG. 2 is a perspective view illustrating a raw material feeding nozzle shown in FIG. 1.
Figure 3:
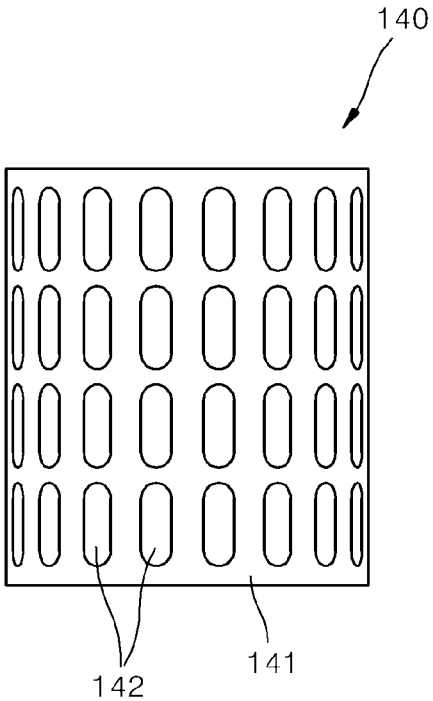
FIG. 3 is a plan view of a raw material discharging nozzle shown in FIG. 2.

The raw material discharging nozzle 140 sprays and discharges the raw material D stored in the raw material mixing tank 130 to the filter tank 150. The raw material discharging nozzle 140 is located on the bottom end of the extension pipe 135 that extends from the raw material mixing tank 130. Referring to FIGS. 1 through 3, the raw material discharging nozzle 140 includes a raw material discharging surface 41 formed convexly in a downward direction. A plurality of spray holes 142 are formed in the raw material discharging surface 141. The plurality of spray holes 142 are uniformly distributed on the raw material discharging surface 141 formed convexly in the downward direction so as to uniformly spray and discharge the raw material D. The raw material discharging surface 141 may also be formed as a curved surface. While the raw material is uniformly sprayed to the filter tank 140 through the plurality of spray holes 142, the raw material D is primarily uniformly sprayed.

In the filter tank 150, the recycling sheet is manufactured by using the raw material D discharged through the raw material discharging nozzle 140. The filter tank 150 includes a filter tank main body 151, a raw material settling unit 160 that is installed inside the filter tank main body 151 and settles the raw material D downward, and a filter unit 165 installed inside the filter tank main body 151.

The filter tank main body 151 includes a bottom 152 and a sidewall 154 extending upwardly from the bottom 152. The bottom 152 is provided with a drainage port 153 for drainage. The sidewall 154 includes a lower sidewall 155 that is formed integrally with the bottom 152, an upper sidewall 156 that is spaced apart from the lower sidewall 155 and located above the lower sidewall 155, and an intermediate sidewall 157 that is located between the lower sidewall 155 and the upper sidewall 156. The raw material settling unit 160 is installed between the intermediate sidewall 157 and the lower sidewall 155, and the filter unit 165 is installed between the intermediate sidewall 157 and the lower sidewall 155. The inner space of the filter tank main body 151 is divided into an intermediate space 151*a* located between the raw material settling unit 160 and the filter unit 165, an upper space 151*b* located above the raw material settling unit 160, and a lower space 151*c* located below the filter unit 165.

The raw material settling unit 160 is installed between the upper space 151*b* and the intermediate space 151*a* and settles the raw material D accommodated in the upper space 151*b* into the intermediate space 151*a*. The raw material settling unit 160 includes a fixed plate material 161, a moving plate material 163 that is movably installed in a state stacked on the fixed plate material 161, and an actuator 165*a* that moves the moving plate material 163.

The fixed plate material 161 is installed to be horizontally arranged between the upper space 151*b* and the intermediate space 151*a*. A plurality of first through holes 162 are formed and uniformly distributed in the fixed plate material 161.

The moving plate material 163 is slidably installed in a horizontal direction with respect to the fixed plate material 161 in a state stacked on the fixed plate material 161. A plurality of second through holes 164 are formed and uniformly distributed in the moving plate material 163. Depending on the moving position of the moving plate material 163, the plurality of first through holes 162 may be clogged by the moving plate material 163 or may be aligned so that each of the positions of the plurality of first through holes 162 coincides with each of the positions of the plurality of second through holes 164, and may be opened. When the plurality of first through holes 162 are aligned so that each of the positions of the plurality of first through holes 162 coincides with each of the positions of the plurality of second through holes 164, the raw material D accommodated in the upper space 151*b* is settled downward toward the intermediate space 151*a* through the first through holes 162 and the second through holes 164. The moving plate material 163 may slide and reciprocate by the actuator 165*a*. In the present embodiment, the moving plate material 163 is located on the fixed plate material 161. However, unlike this, the moving plate material 163 may also be located under the fixed plate material 161, and this also belongs to the scope of the present invention.

The actuator 165*a* slidably reciprocates the moving plate material 163 in the horizontal direction and adjusts the moving position with respect to the fixed plate material 161 of the moving plate material 163.

The filter unit 165 includes a filter net 166 and a net support body 167 for supporting the filter net 166.

The filter net 166 is installed so as to be horizontally disposed inside the filter tank main body 151. Specifically, the filter net 166 is detachably coupled between the upper sidewall 157 and the lower sidewall 155. The filter net 166 allows water that is the rest of the raw material D accommodated in the intermediate space 151*a* to pass downward toward the lower space 151*c*, except for the aggregate of the pulverized waste nonwoven fabric particles and the filler. Water is drained downwardly by the filter net 166, and a recycling sheet made of the aggregate of the pulverized waste nonwoven fabric bodes and the filler remains on the top that is the intermediate space 151*a*. The filter net 166 is structurally supported by the net support body 167.

The net body support 167 is installed inside the filter tank main body 151 to support the filter net 166. Specifically, the net support body 167 is detachably coupled between the upper side wall 157 and the lower side wall 155 and is positioned under the filter net 166 to structurally support the filter net 166.

The drainage pipe 170 extends from the drainage port 153 formed in the bottom 152 of the filter tank main body 151. Water is discharged to the outside from the inner space of the filter tank main body 151 through the drainage pipe 170. A drainage valve 171 for opening and closing the drainage pipe 150 is installed in the drainage pipe 170. In the present embodiment, it is described that water is drained through the drainage pipe 170 by its own weight. Unlike this, a drainage pump may be installed so that water may be drained by the drainage pump. The vacuum forming unit 180 and a water recycling unit 190 are connected to the drainage pipe 170.

The vacuum forming unit 180 discharges air inside the filter tank 150 to the outside through the drainage pipe 170 to form a vacuum in the lower space 151*c* of the filter tank 150. The vacuum forming unit 180 includes a vacuum pump 181 and a connection pipe 182 connecting the vacuum pump 181 and the drainage pipe 170. A portion to which the connection pipe 182 and the drainage pipe 170 are connected, is located upstream of the drainage valve 171. The vacuum pump 181 operates to form a vacuum state in the lower space 151*c* of the filter tank 150, thereby reducing moisture in the recycling sheet formed on the filter net 166.

The water recycling unit 190 includes a water storage tank 191 in which water drained through the drainage pipe 170 is stored, a water supply line 192 that extends between the water storage tank 191 and the mixing tank 110, and a water supply pump 193 installed on the water supply line 192. When the water supply pump 193 operates, water stored in the water storage tank 191 is supplied to the mixing tank 110 through the water supply line 192 and thus, water is recycled.

Figure 4:
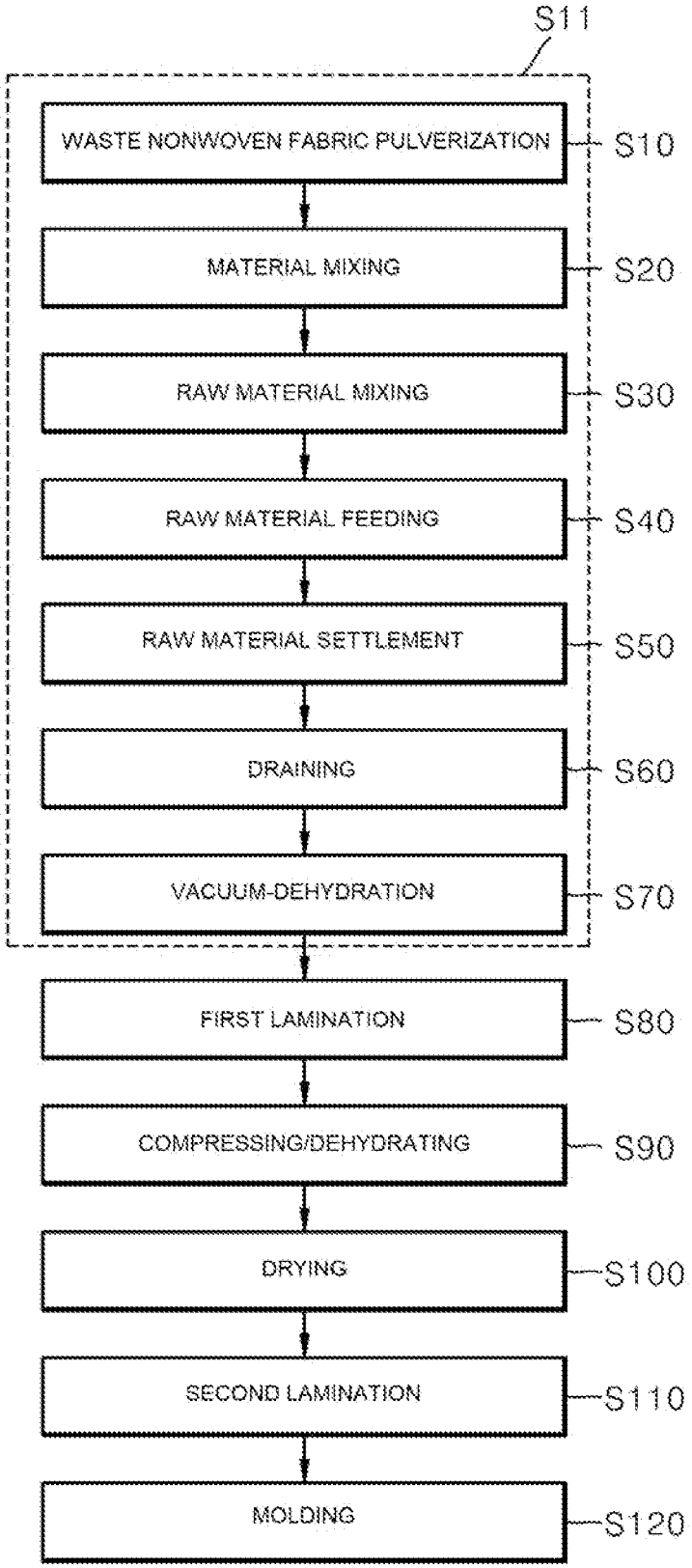
FIG. 4 is a flowchart illustrating a method for recycling a nonwoven fabric by using the apparatus for recycling a nonwoven fabric shown in FIG. 1, according to an embodiment of the present invention.

FIG. 4 is a flowchart illustrating a method for recycling a nonwoven fabric according to an embodiment of the present invention using the apparatus for recycling a nonwoven fabric shown in FIG. 1. A description of the method for recycling a nonwoven fabric shown in FIG. 4 will also include a description of the operation of the apparatus for recycling a nonwoven fabric shown in FIG. 1. Referring to FIG. 4, the method for recycling a nonwoven fabric according to an embodiment of the present invention includes a waste nonwoven fabric pulverizing operation (S10) of pulverizing a waste nonwoven fabric to obtain pulverized waste nonwoven fabric particles, a material mixing operation (S20) of dispersing the pulverized nonwoven fabric particles obtained through the waste nonwoven fabric pulverizing operation (S10) and a filler in water and mixing with each other to obtain a nonwoven fabric mixture, a raw material mixing operation (S30) of adding a fixing agent to the nonwoven fabric mixture obtained through the material mixing operation (S20) and mixing with each other to prepare a raw material, a raw material feeding operation (S40) of feeding the raw material prepared through the raw material mixing operation (S30) into a filter tank, a raw material settling operation (S50) of settling the raw material downward from the filter tank, a draining operation (S60) of draining water from the settled raw material to form a recycling sheet, a vacuum-dehydration operation (S70) of reducing moisture in the recycling sheet by forming a vacuum in the filter tank, a first lamination operation (S80) of laminating a plurality of recycling sheets that have undergone the vacuum-dehydration operation (S60) to form a first laminate, a compressing/dehydrating operation (S90) of compressing and dehydrating the first laminate formed in the first lamination operation (S80), a drying operation (S100) of drying the first laminate that has undergone the compressing/dehydrating operation (S90), a second lamination operation (S110) of laminating separately-prepared different nonwoven fabric sheets on the first laminate that has undergone the drying operation to form a second laminate (S100), and a molding operation (S120) of molding the second laminate formed in the second lamination operation (S110). The material mixing operation (S20), the raw material mixing operation (S30), the raw material feeding operation (S40), the raw material settling operation (S50), the draining operation (S60), and the vacuum-dehydration operation (S70) may be performed by using the apparatus 100 for recycling a nonwoven fabric according to an embodiment of the present invention described with reference to FIG. 1.

In the waste nonwoven fabric pulverizing operation (S10), the nonwoven scrap or nonwoven waste generated in the manufacturing process of the nonwoven fabric product is pulverized by a pulverizer to form pulverized waste nonwoven fabric. In the waste nonwoven fabric pulverizing operation (S10), the pulverized waste nonwoven fabric particles may be preferably pulverized to have a length of 10 mm or less.

In the material mixing operation (S20), the pulverized waste nonwoven fabric particles obtained through the waste nonwoven fabric pulverizing operation (S10) and a filler are dispersed in water and mixed with each other to obtain a nonwoven fabric mixture. The material mixing operation (S20) is performed in the mixing tank 110 of the apparatus 100 for recycling a nonwoven fabric shown in FIG. 1. In the mixing tank 110, the pulverized waste nonwoven fabric particles and the filler are dispersed in water and mixed with each other to form a waste nonwoven fabric mixture A. It is preferable that the pulverized waste nonwoven fabric particles used in the material mixing operation (S20) have the same properties. As the filler, various functional fillers including resin materials for bonding and controlling properties of the pulverized waste nonwoven fabric particles are used. In the mixing tank 110, the pulverized nonwoven fabric particles and the filler are supplied in a state in which the mixing tank 110 is filled with water supplied through the water recycling unit 190, and the pulverized waste nonwoven fabric particles and the filler supplied to the water are evenly dispersed and mixed in water by the agitating unit 111. In the present embodiment, the pulverized nonwoven fabric particles and the filler in the waste nonwoven fabric mixture A have a weight ratio of 8:2.

In the raw material mixing operation (S30), the fixing agent is added to the nonwoven fabric mixture A obtained through the material mixing operation (S20) to prepare a raw material. The raw material mixing operation (S30) is performed in the raw material mixing tank 130 shown in FIG. 1. In the raw material mixing tank 130, the waste nonwoven fabric mixture A supplied from the mixing tank 110 and the fixing agent mixed solution supplied from the fixing agent mixture storage tank 120 are uniformly mixed by the agitating unit 121 so that a raw material D is prepared.

In the raw material feeding operation (S40), the raw material D stored in the raw material mixing tank 130 is fed into the filter tank 150. When the raw material feeding operation (S40) is described in more detail with reference to FIG. 1, the raw material D is discharged to the upper space 151*b* through the raw material discharging nozzle 140 in a state in which water is filled in the lower space 151*c* and the intermediate space 151*a* higher than the filter net 166 in the filter tank 150, and an appropriate amount is supplied to the upper space 151*b* of the filter tank 150. In this case, a moving plate material 163 is located on the raw material settling unit 160 so that the raw material D of the upper space 151*b* is not moved to the intermediate space 151*a*. That is, a plurality of first through holes 162 formed in the fixed plate material 161 and a plurality of second through holes 164 formed in the moving plate material 163 are positioned to be offset from each other. The raw material D fed into the filter tank 150 is present only in the upper space 151*b* by the fixed plate material 161 and the moving plate material 163. In the raw material feeding operation (S40), while the raw material D is uniformly sprayed to the upper space 151*b* through a plurality of spray holes 142 formed in the raw material discharging nozzle 140, the raw material D is uniformly primarily dispersed. After an appropriate amount of the raw material D is filled in the upper space 151*b* through the raw material feeding operation (S40), spraying of the raw material D through the raw material discharging nozzle 140 is stopped by a control valve 136, and the raw material settling operation (S50) is performed.

Figure 5:
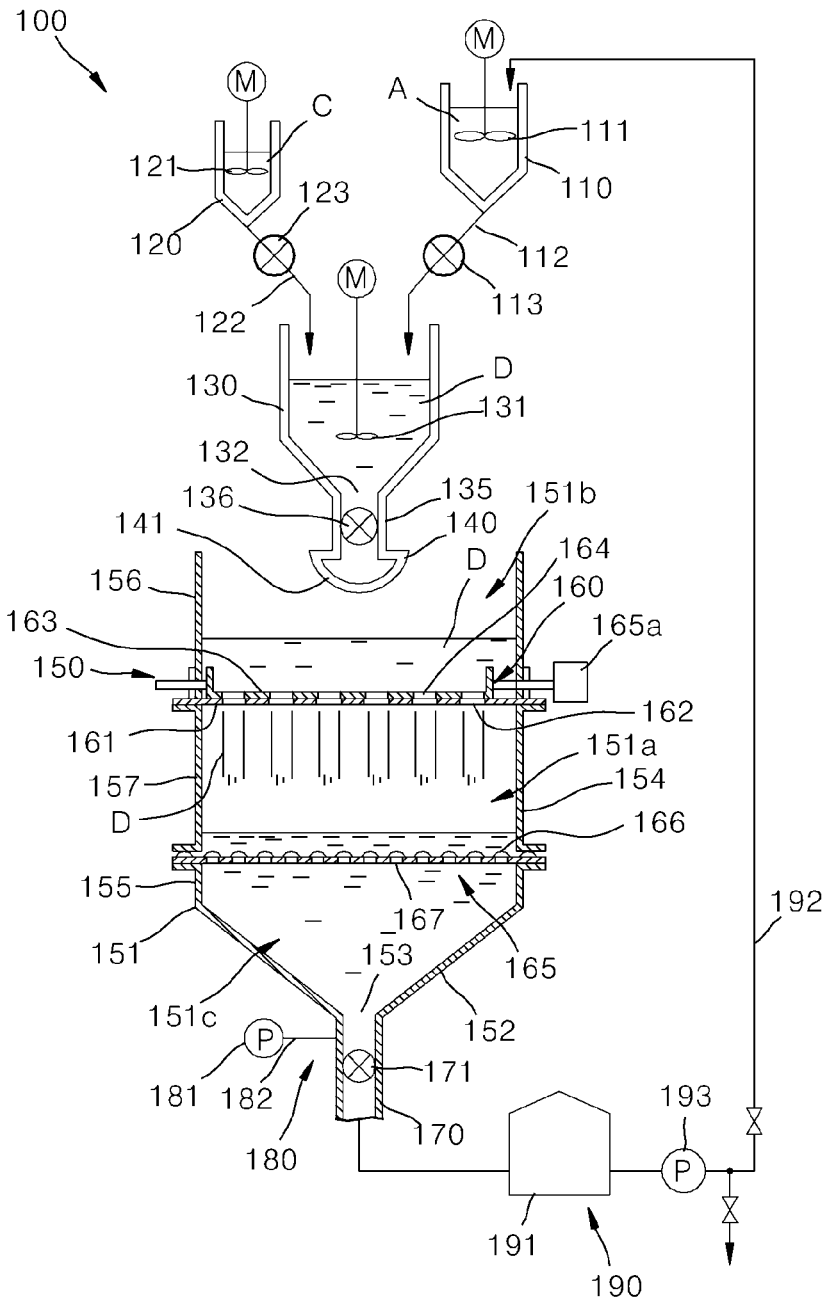
FIG. 5 illustrates a state of a filter tank when a raw material settling operation of the method for recycling a nonwoven fabric of FIG. 4 is performed.

FIG. 5 illustrates a state in which the raw material settling operation (S50) is performed. Referring to FIG. 5, the moving plate material 163 of the raw material settling unit 160 is moved by the actuator 165*a*, and each of the positions of the plurality of second through holes 164 formed in the moving plate material 163 coincides with each of the positions of the plurality of first through holes 162 formed in the fixed plate material 161 so that the raw material D stored in the upper space 151*b* is settled downward through the first through holes 162 and the second through holes 164 and is supplied to the intermediate space 151*a*. The raw material D is settled through the plurality of first through holes 162 and the plurality of second through holes 164 and collides with water accommodated in the intermediate space 151*a* to form an eddy current so that the raw material D is uniformly secondarily dispersed. The raw material D supplied to the intermediate space 151*a* through the raw material settling operation (S50) is present only in the intermediate space 151*a* by the filter net 166. After all the raw materials D in the upper space 151*b* are settled and supplied to the intermediate space 151*a*, the draining operation (S60) is performed.

Figure 6:
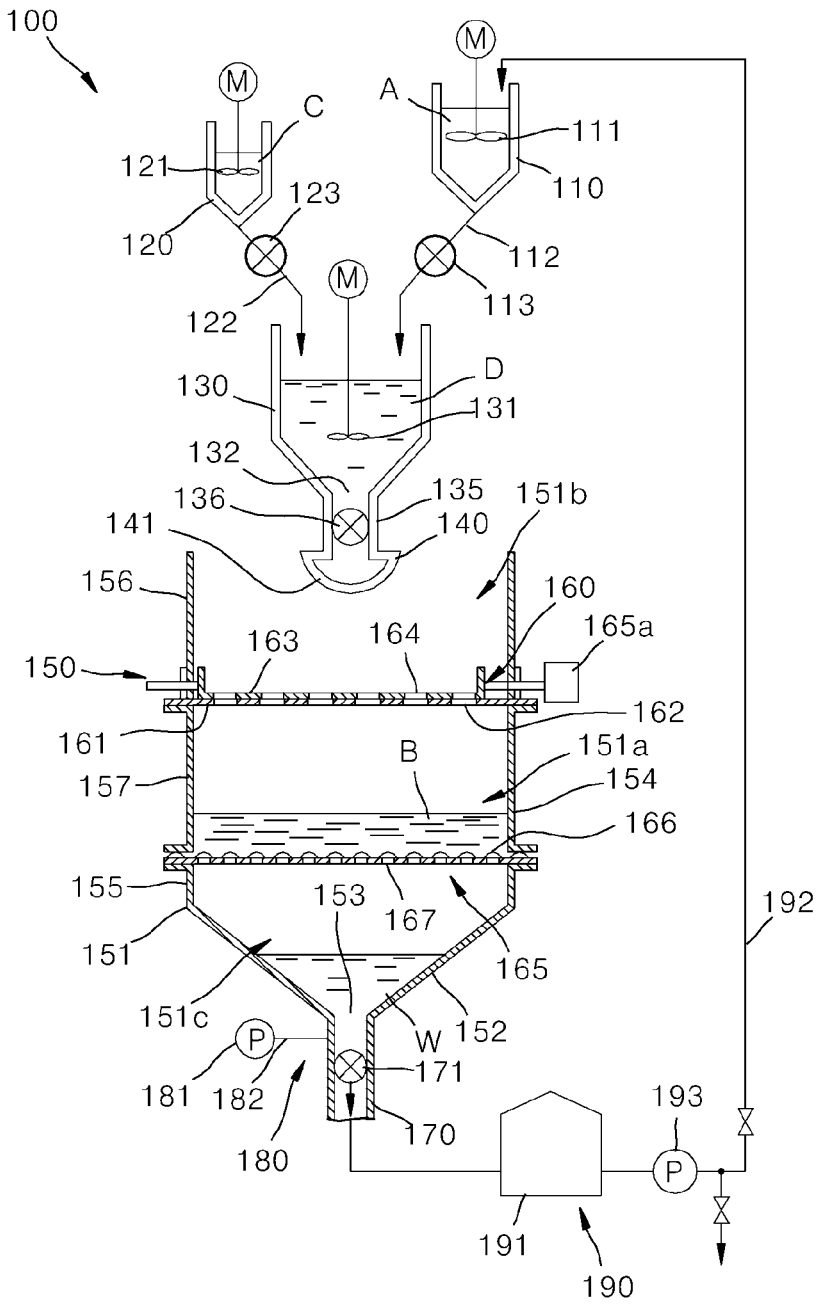
FIG. 6 illustrates a state in which a draining operation of the method for recycling a nonwoven fabric of FIG. 4 is performed.

In the draining operation (S60), water is drained from the filter tank 150 through the drainage port 171. The draining operation S50 is performed by opening the drainage valve 171 installed in the drainage pipe 170. FIG. 6 illustrates a state in which the draining operation (S60) is performed. As shown in FIG. 6, water W is drained through the drainage pipe 170 in the draining operation (S60), and after the water W is completely drained, only the raw material aggregated on the filter net 165 remains, so that a recycling sheet B may be formed. The recycling sheet B formed after the draining operation (S50) contains a considerable amount of water, and contains about 120% of water compared to the recycling sheet B. After the draining operation (S60) is completed, the vacuum-dehydration operation (S70) is performed.

Figure 7:
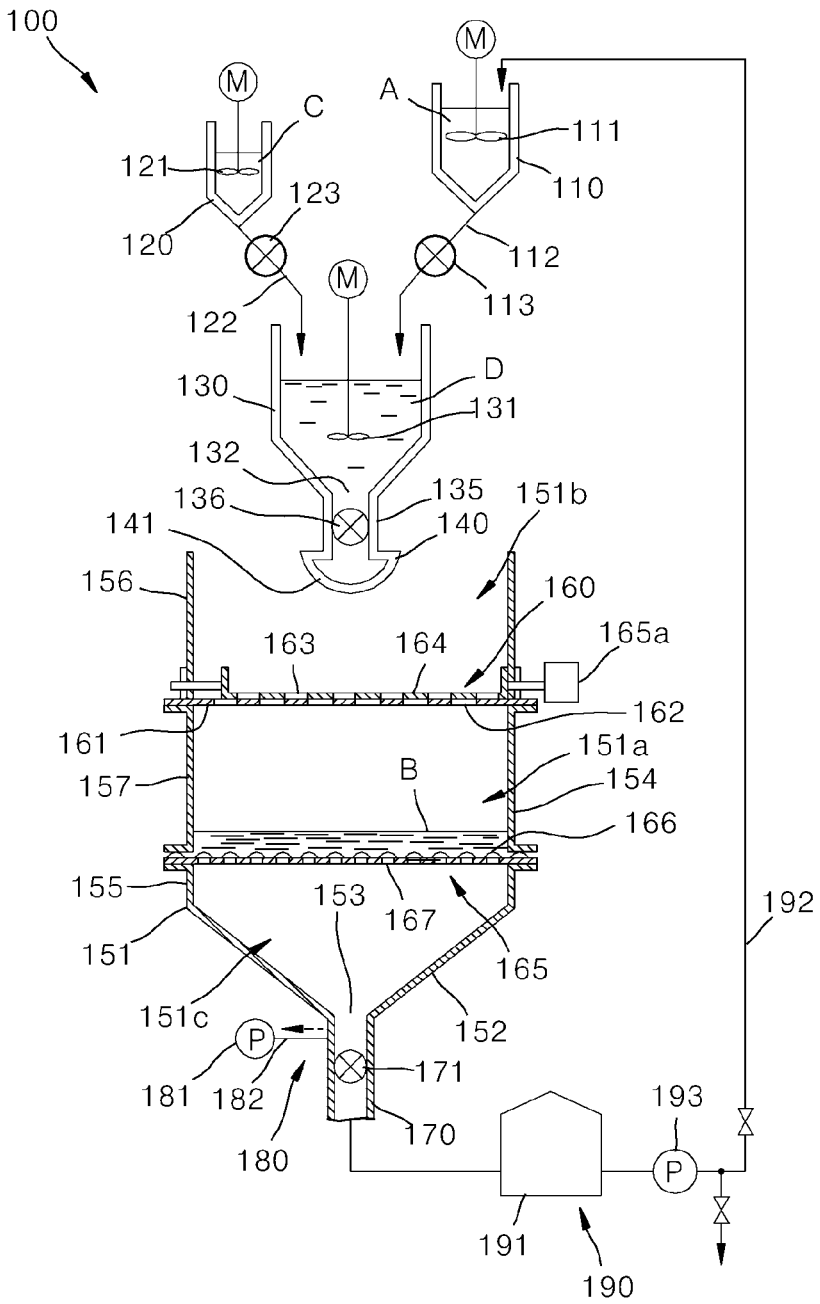
FIG. 7 illustrates a state in which a vacuum-dehydration operation of the method for recycling a nonwoven fabric of FIG. 4 is performed.

In the vacuum-dehydration operation (S70), a vacuum is formed in the filter tank 150 to reduce moisture in the recycling sheet B. FIG. 7 illustrates a state in which the vacuum-dehydration operation (S70) is performed. Referring to FIG. 7, the vacuum-dehydration operation (S60) is performed by operating the vacuum pump 161 while the drainage valve 171 is closed. The lower space 151*c* of the filter tank 150 is sealed by the recycling sheet B stacked on the filter net 166, and the air in the lower space 151*c* is discharged to the outside by the vacuum pump 181 so that a vacuum state may be formed in the lower space 151*c*. Thus, moisture contained in the recycling sheet B is additionally removed. By performing the vacuum-dehydration operation (S60), the moisture content of the recycling sheet B is lowered to a level of about 70% compared to the recycling sheet B.

In the method for recycling the nonwoven fabric shown in FIG. 4, the waste nonwoven fabric pulverizing operation (S10), the material mixing operation (S20), the raw material mixing operation (S30), the raw material feeding operation (S40), the raw material settling operation (S50), the draining operation (S60), and the vacuum-dehydration operation (S70) constitute a recycling sheet manufacturing operation (S11) of the present invention.

Figure 8:
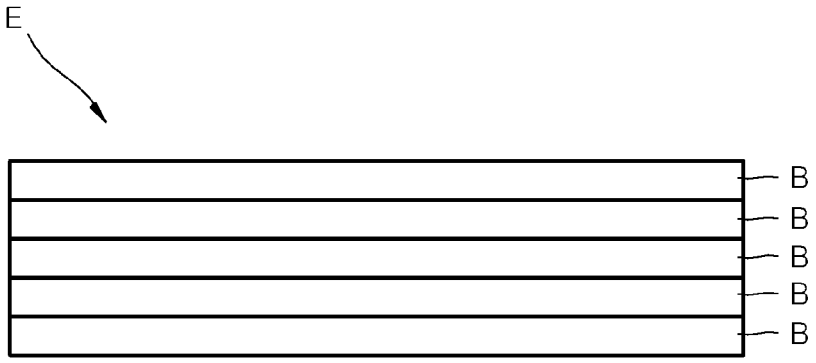
FIG. 8 is a side view illustrating a first laminate formed by a first lamination operation of the method for recycling a nonwoven fabric of FIG. 4.

In the first lamination operation (S80), a plurality of recycling sheets B that have undergone the vacuum-dehydration operation (S70) are stacked to form a laminate. FIG. 8 is a side view of a laminate E formed through the first lamination operation (S80). Referring to FIG. 8, the laminate E includes a plurality of recycling sheets B stacked, and the plurality of recycling sheets B are made of the same waste nonwoven fabric.

Figure 9:
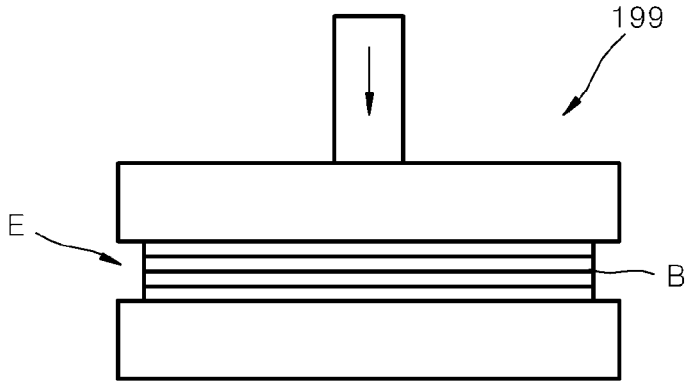
FIG. 9 is a view illustrating a state in which a compressing/dehydrating operation of the method for recycling a nonwoven fabric of FIG. 4 is performed.

In the compressing/dehydrating operation (S90), the laminate E including the plurality of recycling sheets B formed through the first lamination operation (S80) is compressed by a press 199 to be additionally dehydrated, as shown in FIG. 9. By performing the compressing/dehydrating operation (S90), the moisture content of the recycling sheet B is lowered to about 40% compared to the recycling sheet B.

In the drying operation (S100), the laminate E that has undergone the compressing/dehydrating operation (S90) is heat-treated and dried in a high-temperature furnace. By performing the drying operation (S100), the moisture content of the recycling sheet B is lowered to a level of about 3% compared to the recycling sheet B. Although not shown, a shape blanking operation of punching the recycling sheet B that has undergone the compressing/dehydrating operation (S90) before the drying operation (S100) is performed into a shape close to a finished product may be further performed.

Figure 10:
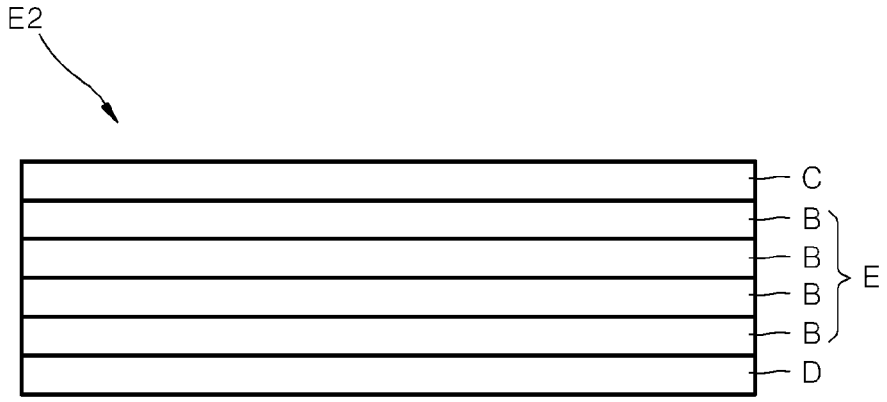
FIG. 10 is a side view illustrating a second laminate formed by a second lamination operation of the method for recycling a nonwoven fabric of FIG. 4.

In the second lamination operation (S110), at least one of separately-prepared different nonwoven fabric sheets is stacked on the laminate E that has undergone the drying operation (S100) to form a laminate. FIG. 10 illustrates an additional laminate formed through the second lamination operation (S110). Referring to FIG. 10, an additional laminate E2 is formed by laminating separately-prepared two different nonwoven sheets C and D on both sides of the laminate E. In the embodiment shown in FIG. 10, two external nonwoven fabric sheets C and D are stacked, however, unlike this, one or three or more nonwoven fabric sheets may be stacked.

In the molding operation (S120), the additional laminate E formed in the second lamination operation (S110) is molded into the finished product by using a mold.

Figure 11:
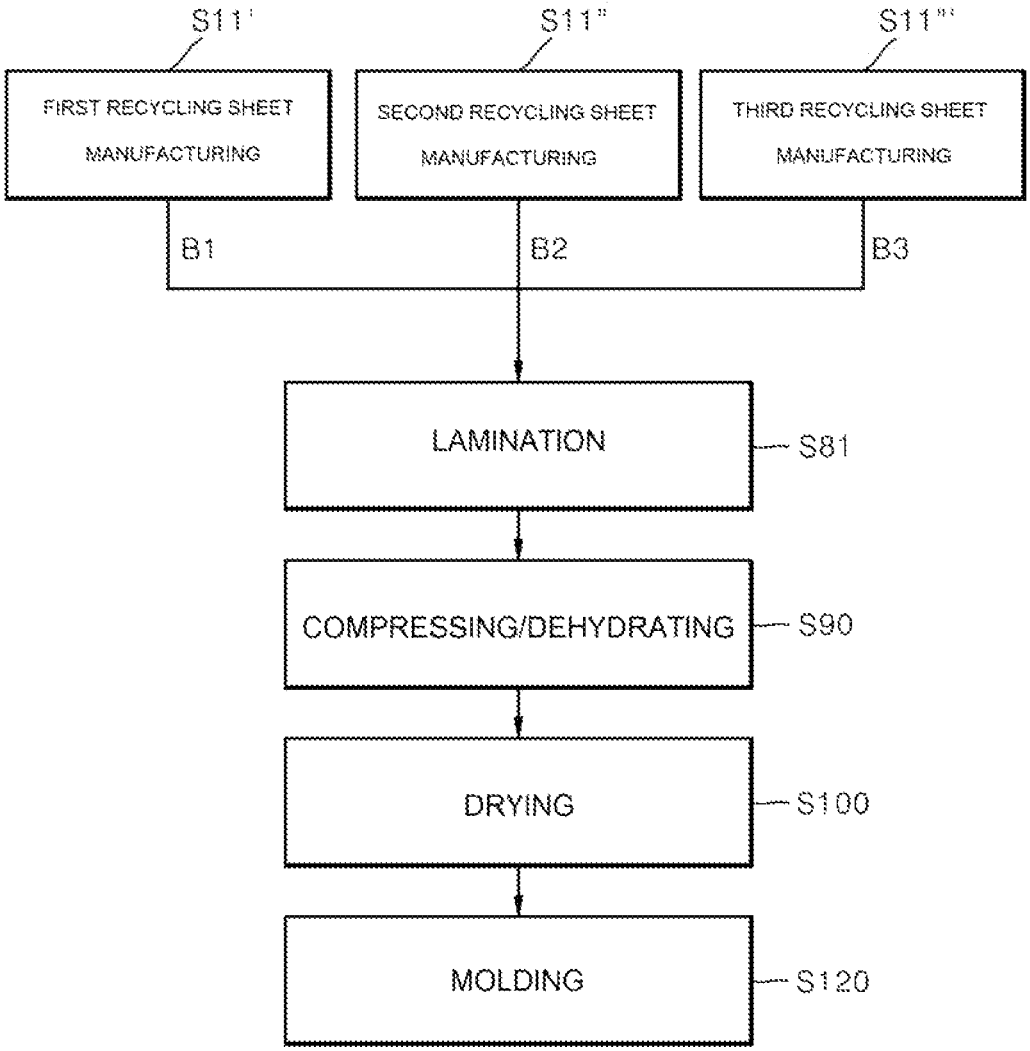
FIG. 11 is a flowchart illustrating a method for recycling a nonwoven fabric according to another embodiment of the present invention.

FIG. 11 is a flowchart illustrating a method for recycling a nonwoven fabric by using the apparatus for recycling a nonwoven fabric shown in FIG. 1, according to another embodiment of the present invention. Referring to FIG. 11, the method for recycling a nonwoven fabric according to an embodiment of the present invention includes a first recycling sheet manufacturing operation (S11') of manufacturing a first nonwoven fabric recycling sheet, a second recycling sheet manufacturing operation (S11") of manufacturing a second nonwoven fabric recycling sheet, a third recycling sheet manufacturing operation (S11'") of manufacturing a third nonwoven fabric recycling sheet, a lamination operation (S81) of laminating a plurality of nonwoven fabric recycling sheets manufactured through each of the recycling sheet manufacturing operations S11', S11", and S11'" to form a laminate, a compressing/dehydrating operation (S90) of compressing and dehydrating the laminate formed through the lamination operation (S81), a drying operation (S100) of drying the laminate that has undergone the compressing/dehydrating operation (S90), and a molding operation (S120) of molding the laminate that has undergone the drying operation (S100).

The first recycling sheet manufacturing operation (S11'), the second recycling sheet manufacturing operation (S11"), and the third recycling sheet manufacturing operation (S11'") are substantially the same as the recycling sheet manufacturing operation (S11) shown in FIG. 4. Through the first recycling sheet manufacturing operation (S11'), a first nonwoven fabric recycling sheet B1 made of a first waste nonwoven fabric is manufactured, and through the second recycling sheet manufacturing operation (S11"), a second nonwoven fabric recycling sheet B2 made of a second waste nonwoven fabric of a different type from that of the first waste nonwoven fabric is manufactured, and through the third recycling sheet manufacturing operation (S11'"), a third nonwoven fabric recycling sheet B3 made of a third waste nonwoven fabric of a different type from those of the first waste nonwoven fabric and the second waste nonwoven fabric is manufactured. In the present embodiment, three recycling sheet manufacturing operations (S11', S11", and S11'") are used. However, unlike this, different types of nonwoven fabric recycling sheets may be manufactured through two recycling sheet manufacturing operations or four or more recycling sheet manufacturing operations, and this also belongs to the scope of the present invention. In the present embodiment, three nonwoven fabric recycling sheets B1, B2, and B3 are manufactured by using different types of waste nonwoven fabrics as raw materials. However, unlike this, at least two nonwoven fabric recycling sheets may be manufactured by using different types of waste nonwoven fabrics as raw materials, and this also belongs to the scope of the present invention.

Figure 12:
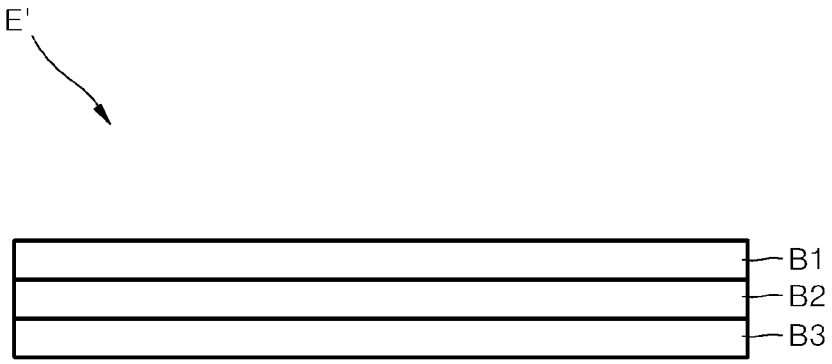
FIG. 12 is a view illustrating a laminate formed by a lamination operation of the method for recycling a nonwoven fabric of FIG. 4.

In the lamination operation (S81), the plurality of different types of nonwoven fabric recycling sheets B1, B2, and B3 manufactured through each of the plurality of recycling sheet manufacturing operations (S11', S11", and S11"') are stacked to form a laminate. FIG. 12 is a side view of a laminate E' formed through the lamination operation (S81). Referring to FIG. 12, the laminate E' includes a plurality of nonwoven fabric recycling sheets B1, B2, and B3 stacked. The plurality of nonwoven fabric recycling sheets B1, B2, and B3 are manufactured by using different type of waste nonwoven fabrics as raw materials.

The compressing/dehydrating operation (S90), the drying operation (S100), and the molding operation (S120) are the same as the compressing/dehydrating operation (S90), the drying operation (S100), and the molding operation (S120) described with reference to FIG. 4 and thus, a detailed description thereof will be omitted.

Figure 13:
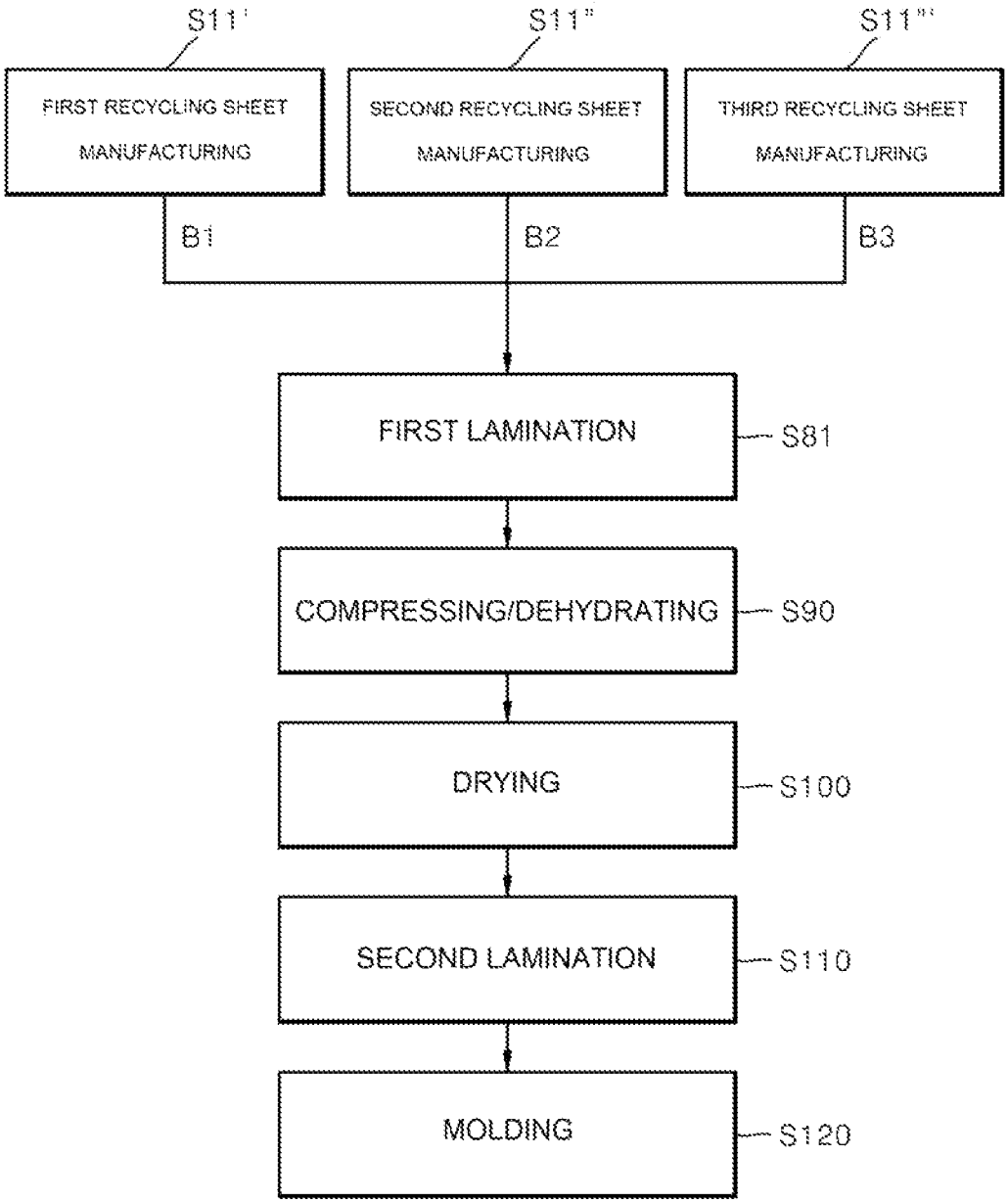
FIG. 13 is a flowchart illustrating a method for recycling a nonwoven fabric according to another embodiment of the present invention.

FIG. 13 is a flowchart illustrating a method for recycling a nonwoven fabric by using the apparatus for recycling a nonwoven fabric shown in FIG. 1, according to another embodiment of the present invention. Referring to FIG. 13, the method for recycling a nonwoven fabric according to an embodiment of the present invention includes a first recycling sheet manufacturing operation (S11') of manufacturing a first nonwoven fabric recycling sheet, a second recycling sheet manufacturing operation (S11") of manufacturing a second nonwoven fabric recycling sheet, a third recycling sheet manufacturing operation (S11"') of manufacturing a third nonwoven fabric recycling sheet, a first lamination operation (S81) of laminating a plurality of nonwoven fabric recycling sheets manufactured through each of the recycling sheet manufacturing operations S11', S11", and S11"' to form a laminate, a compressing/dehydrating operation (S90) of compressing and dehydrating the laminate formed through the first lamination operation (S81), a drying operation (S100) of drying the laminate that has undergone the compressing/dehydrating operation (S90), a second lamination operation (S110) of laminating separately-prepared different nonwoven fabric sheets on the laminate that has undergone the drying operation (S100) to form an additional laminate, and a molding operation (S120) of molding the additional laminate that has undergone the second lamination operation (S110).

The plurality of recycling sheet manufacturing operations (S11', S11", and S11"') and the first lamination operation (S81) are the same as the plurality of recycling sheet manufacturing operations (S11', S11", and S11"') of the embodiment shown in FIG. 11 and the lamination operation (S81) and thus, a detailed description thereof will be omitted. Thus, the laminate E' of the embodiment shown in FIG. 12 is prepared through the plurality of recycling sheet manufacturing operations (S11', S11", and S11"') and the first lamination operation (S81).

The compressing/dehydrating operation (S90), the drying operation (S100), the second lamination operation (S110), and the molding operation (S120) are the same as the compressing/dehydrating operation (S90), the drying operation (S100), the second lamination operation (S110), and the molding operation (S120) of the embodiment shown in FIG. 4 and thus, a detailed description thereof will be omitted.

Figure 14:
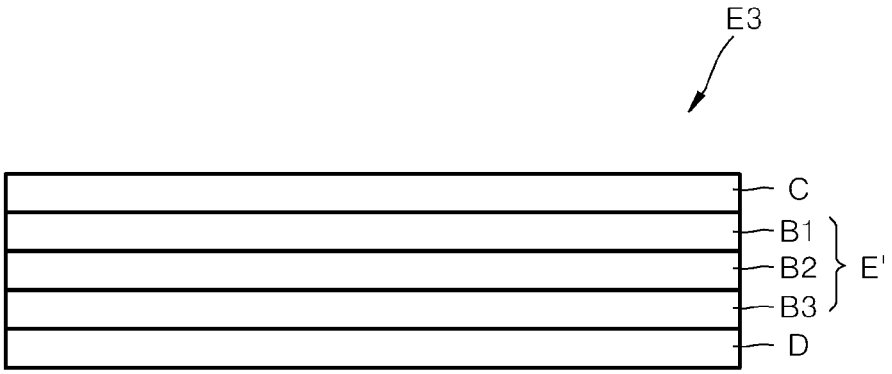
FIG. 14 is a side view illustrating a second laminate formed by a second lamination operation of the method for recycling a nonwoven fabric of FIG. 11.

FIG. 14 illustrates an additional laminate formed through the second lamination operation (S110). Referring to FIG. 14, an additional laminate E3 is formed by laminating separately-prepared two different nonwoven fabric sheets C and D on both sides of the laminate E'. In the embodiment shown in FIG. 14, two external nonwoven fabric sheets C and D are stacked, however, unlike this, one or three or more nonwoven fabric sheets may be stacked.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A method for recycling a nonwoven fabric, the method comprising:

a waste nonwoven fabric pulverization operation of pulverizing a waste nonwoven fabric to obtain pulverized waste nonwoven fabric particles;

a material mixing operation of dispersing and mixing the pulverized nonwoven fabric particles and a filler in water to obtain a nonwoven fabric mixture;

a raw material mixing operation of adding a fixing agent for agglomeration of the pulverized waste nonwoven fabric particles and the filler to the nonwoven fabric mixture, followed by mixing, to form a raw material;

a raw material feeding operation of spraying the raw material into an upper space by using a raw material discharging nozzle and supplying the raw material;

a raw material settling operation of settling the raw material filled in the upper space into an intermediate space, which is located below the upper space and in which a filter net for passing water downward is installed on a bottom;

a draining operation of draining water from a lower space located below the intermediate space to form a nonwoven fabric recycling sheet on the filter net; and a first lamination operation of laminating a plurality of nonwoven fabric recycling sheets to form a laminate.

2. The method of claim 1, wherein the plurality of nonwoven fabric recycling sheets comprise at least two nonwoven fabric recycling sheets manufactured by using different types of waste nonwoven fabric sheets.

3. The method of claim 1, further comprising a second lamination operation of laminating at least one of separate nonwoven fabric sheets on the laminate to form an additional laminate.

4. The method of claim 1, wherein, in the raw material settling operation, the raw material is settled into the intermediate space through a plurality of through holes uniformly distributed to an entire bottom of the upper space.

5. The method of claim 1, wherein, in the raw material settling operation, the raw material is fed in a state in which water is filled in the intermediate space and the lower space higher than the filter net.

6. The method of claim 1, further comprising, after the draining operation is performed, a vacuum-dehydration operation of discharging air in the lower space to dehydrate the recycling sheet.

7. The method of claim 1, further comprising a compressing/dehydrating operation of compressing and dehydrating the laminate.

8. The method of claim 1, further comprising a drying operation of heat-treating and drying the laminate.

9. The method of claim 1, wherein the raw material discharging nozzle comprises a plurality of spray holes through which the raw material is discharged, formed therein and a raw material discharging surface convexly formed in a downward direction, and the raw material is uniformly sprayed into the upper space.

* * * * *